US010233409B2

(12) United States Patent
Frankenbach et al.

(10) Patent No.: US 10,233,409 B2
(45) Date of Patent: Mar. 19, 2019

(54) LIQUID CLEANING COMPOSITIONS

(71) Applicant: The Procter & Gamble Company, Cincinnati, OH (US)

(72) Inventors: Gayle Marie Frankenbach, Cincinnati, OH (US); Jan Richard Davis, Harlan Township, OH (US); Vince Paul Boeh, Green Township, OH (US); Michael Gabriel Emley, Guilford, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 430 days.

(21) Appl. No.: 13/944,905

(22) Filed: Jul. 18, 2013

(65) Prior Publication Data

US 2014/0026331 A1 Jan. 30, 2014

Related U.S. Application Data

(60) Provisional application No. 61/675,850, filed on Jul. 26, 2012.

(30) Foreign Application Priority Data

Jul. 16, 2013 (WO) ..... PCT/US2013/050658

(51) Int. Cl.
*C11D 3/20* (2006.01)
*C11D 3/386* (2006.01)

(52) U.S. Cl.
CPC ..... *C11D 3/2086* (2013.01); *C11D 3/2075* (2013.01); *C11D 3/38618* (2013.01); *C11D 3/38663* (2013.01)

(58) Field of Classification Search
CPC . C11D 3/2086; C11D 3/38618; C11D 3/2075; C11D 3/38663
USPC ..... 8/137; 510/76, 300, 301, 320, 321, 337, 510/361, 370, 374, 392, 393, 400, 405, 510/434, 535
See application file for complete search history.

(56) References Cited

U.S. PATENT DOCUMENTS

| | | | | |
|---|---|---|---|---|
| 4,529,525 | A | 7/1985 | Dormal et al. | |
| 5,883,062 | A * | 3/1999 | Addison et al. | 510/235 |
| 5,972,869 | A | 10/1999 | Cao et al. | |
| 6,121,219 | A | 9/2000 | Herdt et al. | |
| 6,365,562 | B1 * | 4/2002 | Fischer et al. | 510/311 |
| 7,148,187 | B1 | 12/2006 | Simon et al. | |
| 7,217,752 | B2 | 5/2007 | Schmucker-Castner et al. | |
| 8,110,539 | B2 | 2/2012 | Lenoir | |
| 2002/0160928 | A1 * | 10/2002 | Smerznak | C11D 1/72 510/405 |
| 2006/0111261 | A1 * | 5/2006 | Sadlowski et al. | 510/221 |
| 2009/0305937 | A1 * | 12/2009 | Price et al. | 510/351 |
| 2011/0075466 | A1 | 3/2011 | Thorp et al. | |
| 2013/0184195 | A1 | 7/2013 | Sadlowski et al. | |

FOREIGN PATENT DOCUMENTS

| | | | |
|---|---|---|---|
| JP | 2008-189751 A | | 8/2008 |
| WO | WO 2009/0154614 | * | 12/2009 |
| WO | WO 2009/154614 A1 | | 12/2009 |

OTHER PUBLICATIONS

PCT Intemation Search Repodt; dated Sep. 13, 2013; 11 Pages.

* cited by examiner

*Primary Examiner* — Amina S Khan
(74) *Attorney, Agent, or Firm* — Andres E. Velarde; Gregory S. Darley-Emerson

(57) ABSTRACT

Disclosed are cleaning compositions and methods for cleaning fabrics to which stains are adhered. The cleaning composition contains a surfactant system comprising one or more anionic surfactants, a cleaning enzyme, and an organic acidulant having a calculated stability constant for $Ca^{2+}$ ions of less than about 1.5 at a pH of about 4. The cleaning composition has a neat pH of from about 2 to about 6.

11 Claims, No Drawings

LIQUID CLEANING COMPOSITIONS

TECHNICAL FIELD

The present disclosure relates to low pH liquid cleaning compositions that contain enzymes.

BACKGROUND

Typical consumer detergent compositions may have pH values ranging from 7 to as high as 11. However, low pH detergent compositions, e.g., compositions having a pH ranging from about 2 to about 6, can provide a variety of benefits. Low pH compositions may reduce malodor on fabrics, aid in the release of calcium soaps that tend to capture soils on fabrics, improve performance on pH-sensitive stains, and even provide benefits on fabric feel.

Low pH approaches have been avoided, particularly in enzyme-containing liquid detergent formulations, because low pH may cause enzyme instability (and hence, reduced enzyme activity) in a liquid detergent composition. A low pH may lead to the denaturation of enzymes, resulting in a loss of enzymatic activity. Furthermore, in some low pH detergent compositions, low pH is achieved by the use of citric acid, a weak acid that is also used as a builder. Citric acid has been found to lower enzyme activity in liquid detergent compositions.

Therefore, there remains an ongoing need for a low pH liquid cleaning composition that is compatible with enzymes.

SUMMARY

The present invention attempts to solve this need and other needs by providing, in one aspect of the invention, a liquid cleaning composition comprising a) from about 10% to about 60%, by weight of the liquid cleaning composition, of a surfactant system comprising from about 20% to about 97%, by weight of the surfactant system, of one or more anionic surfactants, b) from about 0.0001% to about 5%, by weight of the liquid cleaning composition, of a cleaning enzyme, and c) from about 2% to about 20%, by weight of the liquid cleaning composition, of an organic acidulant having a calculated stability constant for $Ca^{2+}$ ion of less than about 1.5 at a pH of about 4, wherein the cleaning composition has a neat pH of from about 2 to about 6.

Another aspect of the invention includes a method for treating fabric comprising providing a fabric to which stains are adhered and contacting said fabric with a wash solution comprising water and a cleaning composition comprising a) from about 10% to about 60%, by weight of the liquid cleaning composition, of a surfactant system comprising from about 20% to about 97%, by weight of the surfactant system, of one or more anionic surfactants, b) from about 0.0001% to about 5%, by weight of the liquid cleaning composition, of a cleaning enzyme, and c) from about 2% to about 20%, by weight of the liquid cleaning composition, of an organic acidulant having a calculated stability constant for $Ca^{2+}$ ion of less than about 1.5 at pH 4, wherein the cleaning composition has a neat pH of from about 2 to about 6.

DETAILED DESCRIPTION OF THE INVENTION

As used herein, the articles "a" and "an" when used in a claim, are understood to mean one or more of what is claimed or described.

As used herein, "low pH detergent composition" refers to a detergent composition having a pH ranging from about 2 to about 6.

As used herein, the terms "include," "includes," and "including" are meant to be non-limiting.

As used herein, an "acidulant" is a compound added to a detergent composition to reduce its pH.

As used herein, "free water" means water which is not bound by chemical moieties (polymers, salts, etc.) or microstructures (e.g. lamellar phases, surfactant-polymer associations, and other aggregates of assembled molecules) and thus has the chemical potential to diffuse readily and interact with components of the formulation to cause or enable chemical or physical changes to the formulation.

Unless otherwise noted, all component or composition levels are in reference to the active portion of that component or composition, and are exclusive of impurities, for example, residual solvents or by-products, which may be present in commercially available sources of such components or compositions.

As used herein, all concentrations and ratios are on a weight basis of the liquid cleaning composition unless otherwise specified.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Cleaning Compositions

The present invention relates to low pH cleaning compositions that are compatible with enzymes. It has been discovered that the selection of the acidulant in such a low pH composition affects the stability of enzymes in the composition.

The liquid cleaning compositions of the present invention comprise a surfactant system comprising one or more anionic surfactants, a cleaning enzyme, and an organic acidulant having a calculated stability (binding) constant for $Ca^{2+}$ ion of less than about 1.5 at a pH of about 4.

It is believed that enzyme stability may be improved by maintaining a supply of $Ca^{2+}$ ions available to bind with the enzymes in the product. Enzyme stability may also be improved by selecting an acidulant having a buffering capacity in the range of the pH of the finished product. Enzyme stability may be also improved by reducing the free water in the composition. Furthermore, reducing free water may also help to maintain the physical stability of the composition; it is believed that as a product separates into multiple phases, a phase having an increased level of free water forms and the rate of enzyme degradation may be increased in this phase.

The cleaning compositions of the invention typically comprise less than about 40% water, more typically less than about 30% water, and generally between about 10 and about 28% water. The compositions of the present invention generally have neat pHs ranging from about 2.0 to about 6.0, or from about 3.0 to about 6.0, or from about 3 to about 5.5, or from about 4 to about 5.2, or from about 4.5 to about 5.5.

The liquid cleaning compositions of the present invention may be in various suitable liquid forms. In one example, the liquid form is a gel form. In some examples, the cleaning compositions may include, unless otherwise indicated, all-purpose or heavy duty washing agents, in particular, laundry detergents, fine-fabric detergents, hand dishwashing or light duty dishwashing agents, machine dish washing agents, cleaning and disinfectant agents for household or institutional use, cleaning auxiliaries (e.g., fabric or stain pre-treatment compositions), or other suitable cleaning products that may be apparent to one skilled in the art in view of the teachings herein.

The components of the liquid cleaning compositions herein, as well as composition form, preparation, and use, are described in greater detail as follows.

Organic Acidulant

In some aspects, the liquid cleaning compositions comprise an organic acidulant in an amount sufficient to stabilize enzymes present in the composition and to establish a composition pH of between about 2.0 and about 6.0. In other aspects, the organic acidulant is present in an amount sufficient to stabilize enzymes present in the composition and to establish a composition pH of between about 3.0 and about 6.0. In further aspects, the organic acidulant is present in an amount sufficient to stabilize enzymes present in the composition and to establish a composition pH of between about 3.5 and about 5.5. In some aspects, the liquid cleaning composition may comprise from about 2% to about 20%, by weight of the composition, of an organic acidulant. In other aspects, the liquid cleaning composition may comprise from about 4% to about 15%, by weight of the composition, of an organic acidulant. In further aspects, the liquid cleaning composition may comprise from about 5% to about 10%, by weight of the composition, of an organic acidulant.

The organic acidulant may be any organic acid that has a calculated stability (binding) constant for $Ca^{2+}$ ion of less than about 1.5 at a pH of 4 using the method described herein. The organic acidulant may further donate from one to two protons (hydrogen ions) per molecule. In some examples, the organic acidulant may donate one proton per molecule.

Calculated stability constants for $Ca^{2+}$ ion are available from the National Institute of Standards and Technology Data Base under the direction of the U.S. Department of Commerce. The calculated stability constants for $Ca^{2+}$ ion of a non-limiting group of organic acidulants are provided in Table 1.

TABLE 1

| Acid | $Ca^{2+}$ Binding Log K [ML]/[M][L] pH = 4 | $Ca^{2+}$ Binding Log K [ML]/[M][L] pH = 8 | $Ca^{2+}$ Binding Log K [ML]/[M][L] No pH Adjustment |
|---|---|---|---|
| Acetic | −0.1 | 0.5 | 0.6 |
| Lactic | 1.0 | 1.1 | 1.1 |
| Citric | 1.7 | 3.7 | 3.7 |
| EDTA | 2.3 | 8.6 | 10.4 |
| Oxalic | 3.0 | 3.2 | 3.2 |
| Adipic | −1.5 | 2.2 | 2.2 |
| Malonic | 0.7 | 1.5 | 1.5 |
| Maleic | 0.5 | 1.6 | 1.6 |
| Succinic | −0.3 | 1.2 | 1.2 |
| Glycolic | 0.8 | 1.1 | 1.1 |
| Propionic | −0.2 | 0.5 | 0.5 |
| Butyric | −0.2 | 0.5 | 0.5 |

Source: National Institute of Standards and Technology ("NIST"), R. M. Smith, and A. E. Martell, NIST Standard Reference Database 46, NIST Critically Selected Stability Constants of Metal Complexes: Version 8.0, May 2004, U.S. Department of Commerce, Technology Administration, NIST, Standard Reference Data Program, Gaithersburg, MD.

Suitable organic acidulants that may be used herein include α-hydroxy acids (AHA), organic acids, and their alkali metal salts, e.g., sodium and potassium salts. A suitable organic acidulant has a calculated stability constant for $Ca^{2+}$ ion of less than about 1.5, or less than or equal to about 1.0, and greater than about −3.0 at a pH of 4. A suitable organic acidulant comprises one to two carboxylic acid groups and/or one to two hydroxyl groups. In some examples, the organic acidulant has a calculated stability constant for $Ca^{2+}$ ion of less than about 1.5 at a pH of 4 and one carboxylic acid group and/or one hydroxy group. In some examples, the organic acidulant may further have from about 2 carbon atoms to about 9 carbon atoms. In other examples, the organic acidulant may further have from about 3 carbon atoms to about 6 carbon atoms. Specific non-limiting examples of organic acidulants that may be used herein include glycolic acid, succinic acid, glutaric acid, aspartic acid, lactic acid and acetic acid. In some examples, lactic acid is the organic acidulant.

In general, citric acid is not intentionally added to the compositions disclosed herein. Citric acid is not a suitable organic acidulant because it has a stability constant for $Ca^{2+}$ ion of greater than about 1.5 at a pH of 4. However, citric acid may be present in a composition of the invention as an impurity in a raw material component of the composition.

Surfactant System

The liquid cleaning compositions comprises a surfactant system in an amount sufficient to provide desired cleaning properties. In some examples, the liquid cleaning composition comprises, by weight of the composition, from about 0.1% to about 60% of a surfactant system. In other examples, the liquid cleaning composition comprises, by weight of the composition, from about 1% to about 50% of the surfactant system. In further examples, the liquid cleaning composition comprises, by weight of the composition, from about 5% to about 45% of the surfactant system. The surfactant system may comprise a detersive surfactant selected from nonionic surfactants, anionic surfactants, cationic surfactants, amphoteric surfactants, zwitterionic surfactants, and mixtures thereof. In a more specific embodiment, the surfactant system comprises anionic surfactant, nonionic surfactant, or mixtures thereof. Those of ordinary skill in the art will understand that a detersive surfactant encompasses any surfactant or mixture of surfactants that provide cleaning, stain removing, or other laundering benefit to fabrics during the laundering process.

Anionic Surfactants

In some examples, the surfactant system of the liquid cleaning composition may comprise from about 20% to about 97%, by weight of the surfactant system, of one or more anionic surfactants. In other examples, the surfactant system of the liquid cleaning composition may comprise from about 25% to about 90%, by weight of the surfactant system, of one or more anionic surfactants. In further examples, the surfactant system of the liquid cleaning composition may comprise from about 35% to about 80%, by weight of the surfactant system, of one or more anionic surfactants. In further examples, the surfactant system may consist essentially of, or even consist of one or more anionic surfactants.

Specific, non-limiting examples of suitable anionic surfactants include any conventional anionic surfactant typically used in detergent products. These include the alkyl benzene sulfonic acids and their salts as well as alkoxylated or non-alkoxylated alkyl sulfate materials.

Exemplary anionic surfactants are the alkali metal salts of $C_{10}$-$C_{16}$ alkyl benzene sulfonic acids, or $C_{11}$-$C_{14}$ alkyl benzene sulfonic acids. In one aspect, the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially useful are the sodium and potassium linear straight chain alkylbenzene sulfonates in which the average number of carbon atoms in the alkyl group is from about 11 to 14. Sodium $C_{11}$-$C_{14}$, e.g., $C_{12}$, LAS is a specific example of such surfactants.

Another exemplary type of anionic surfactant comprises ethoxylated alkyl sulfate surfactants. Such materials, also known as alkyl etromher sulfates or alkyl polyethoxylate sulfates, are those which correspond to the formula: R'—O—$(C_2H_4O)_n$—$SO_3M$ wherein R' is a $C_8$-$C_{20}$ alkyl group, n is from about from 0.5 to 20, or from 1 to 20, and M is a salt-forming cation. In one aspect, R' is $C_{10}$-$C_{18}$ alkyl, n is from about 1 to 15, and M is sodium, potassium, ammonium, alkylammonium, or alkanolammonium. In one aspect, R' is a $C_{12}$-$C_{16}$, n is from about 0.5 to 6, or from 1 to 6 and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this invention and used as or in any anionic surfactant component which may be present. Specific examples of non-alkoxylated, e.g., non-ethoxylated, alkyl ether sulfate surfactants are those produced by the sulfation of higher $C_8$-$C_{20}$ fatty alcohols. Conventional primary alkyl sulfate surfactants have the general formula: $ROSO_3$-$M^+$ wherein R is typically a linear $C_8$-$C_{20}$ hydrocarbyl group, which may be straight chain or branched chain, and M is a water-solubilizing cation. In one aspect, R is a $C_{10}$-$C_{15}$ alkyl, and M is alkali metal, more specifically R is $C_{12}$-$C_{14}$ and M is sodium.

Specific, non-limiting examples of anionic surfactants useful herein include: a) $C_{10}$-$C_{18}$ alkyl benzene sulfonates (LAS) including those in which the alkyl groups have a bio-based content of at least 5% (Bio-LAS and/or Bio-MLAS) b) $C_{10}$-$C_{20}$ primary, branched-chain and random alkyl sulfates (AS), including predominantly $C_{12}$ alkyl sulfates; c) $C_{10}$-$C_{18}$ secondary (2,3) alkyl sulfates having formulae (I) and (II): wherein M in formulae (I) and (II) is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of suitable cations including sodium, potassium, ammonium, and mixtures thereof, and x is an integer of at least about 7, or at least about 9, and y is an integer of at least 8, or at least about 9; d) $C_{10}$-$C_{18}$ alkyl alkoxy sulfates ($AE_xS$) wherein x is from 1-30; e) $C_{10}$-$C_{18}$ alkyl alkoxy carboxylates in one aspect, comprising 1-5 ethoxy units; f) mid-chain branched alkyl sulfates as discussed in U.S. Pat. Nos. 6,020,303 and 6,060,443; g) mid-chain branched alkyl alkoxy sulfates as discussed in U.S. Pat. Nos. 6,008,181 and 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

Another suitable class of anionic surfactants comprises surfactant derivatives of isoprenoid-based polybranched detergent alcohols as described in US 2010/0137649. A suitable feedstock for these includes beta-farnesene, such as BioFene™ supplied by Amyris, Emeryville, Calif.

Another suitable anionic surfactant is a branched surfactant from isoprenoid-derived alcohols, anteiso and iso-alcohols. This includes mixtures of at least two compounds of Formula I:

I

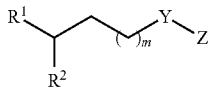

In this mixture, $R^1$ is hydrogen, methyl, or ethyl;

$R^2$ is $(C_1$-$C_n)$alkyl or $(C_1$-$C_n)$alkenyl having 0, 1, 2, or 3 $(C_1$-$C_3)$alkyl branches;

m is 5-37 and n is 1-33, wherein m+n is 6-38; preferably m is 7-27 and n is 1-23, wherein m+n is 8-28;

Y is null or $W_p$;

W is selected from the group consisting of ethylenoxy, propylenoxy, butylenoxy, and mixtures thereof;

p is 1 to 30; and

Z is a hydrophilic moiety such as, for example, hydroxy, carboxylate, sulfate, disulfate, sulfonate, disulfonate, glycerol ester sulfonate, amine, monoalkylamine, dialkylamine, amine oxide, a polyhydroxy moiety, a phosphate ester, glycerol sulfonate, polygluconate, a polyphosphate ester, phosphonate, sulfosuccinate, sulfosuccaminate, glucamide, taurinate, sarcosinate, glycinate, isethionate, dialkanolamide, monoalkanolamide, monoalkanolamide sulfate, diglycolamide, diglycolamide sulfate, a glycerol ester, a glycerol ester sulfate, a glycerol ether, a glycerol ether sulfate, a polyglycerol ether, a polyglycerol ether sulfate, sorbitan ester, an alkylpolyglycoside (APG), alkylpolyxyloside, urea, ammonioalkanesulfonate, amidopropyl betaine, an allylated quat, an alkyated/polyhydroxyalkylated quat, an alkylated quat, an alkylated/polyhydroxylated oxypropyl quat, a glycerol ester quat, a glycol amine quat, imidazoline, alken-2-yl-succinate, a sulfonated alkyl ester, and a sulfonated fatty acid. Preferably, Z is selected from the group consisting of hydroxy, glycerol ether, polyglycerol ether, polyglycoside, polyxyloside, carboxylate, sulfate, sulfonate, glycerol ether sulfonate, amine, monoalkylamine, dialkylamine, amine oxide, monoalkanolamide, amidopropyl betaine, and an alkylated quat. In one aspect herein, the foregoing selections for Z do not include carboxylate.

In one aspect, with respect to at least one of the compounds, when $R^1$ is H, $R^2$ has 1, 2, or 3 $(C_1$-$C_3)$ alkyl branches, and when $R^1$ is methyl or ethyl, $R^2$ has 0, 1, or 2 $(C_1$-$C_3)$alkyl branches. In another aspect, with respect to the at least two compounds in the mixture, when $R^1$ is H, $R^2$ has 1, 2, or 3 $(C_1$-$C_3)$ alkyl branches, and when $R^1$ is methyl or ethyl, $R^2$ has 0, 1, or 2 $(C_1$-$C_3)$alkyl branches. Alternatively or additionally, in yet another aspect, the branching occurs on carbon atoms that are within 40% of the nonfunctionalized terminus of the longest carbon chain. Alternatively or additionally, in yet another aspect, the composition is substantially free of secondary hydroxy compounds.

Another suitable anionic surfactant comprises a mixture of at least two compounds selected from the group consisting of:

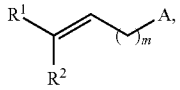

-continued

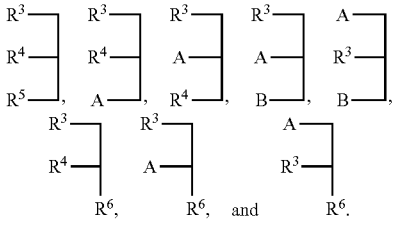

In this mixture, A and B are each independently OH or $O(C{=}O)R^7$;

$R^1$ is hydrogen, methyl, or ethyl;

$R^2$ is $(C_1\text{-}C_n)$alkyl or $(C_1\text{-}C_n)$alkenyl having 0, 1, 2, or 3 $(C_1\text{-}C_3)$alkyl branches;

$R^3$, $R^4$, and $R^5$ are each independently

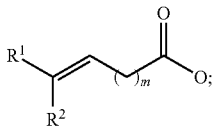

$R^6$ is hydrogen, methyl, or ethyl;

$R^7$ is $(C_1\text{-}C_{26})$ alkyl; and, m is 5-37 and n is 1-33, wherein m+n is 6-38; preferably m is 7-27 and n is 1-23, wherein m+n is 8-28.

In one aspect, when $R^1$ is H, $R^2$ has 1, 2, or 3 $(C_1\text{-}C_3)$ alkyl branches, and when $R^1$ is methyl or ethyl, $R^2$ has 0, 1, or 2 $(C_1\text{-}C_3)$alkyl branches. Alternatively or additionally, in yet another aspect, the branching occurs on carbon atoms that are within 40% of the nonfunctionalized terminus of the longest carbon chain. Alternatively or additionally, in yet another aspect, the composition is substantially free of secondary hydroxy compounds.

In another aspect, a suitable anionic surfactant comprises the partially saturated versions of the above compounds or fully saturated versions of the above compounds, wherein an above compound is hydrogenated to provide the partially saturated or fully saturated version thereof.

A suitable anionic surfactant may also comprise a mixture of at least two compounds of Formula IV:

(IV)

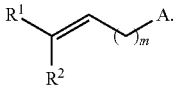

In this mixture, A in each of the at least two compounds is independently COOH, $COO^-M$, $O(C{=}O)R^7$ or $(C{=}O)OR^7$;

$R^1$ is hydrogen, methyl, or ethyl;

$R^2$ is $(C_1\text{-}C_n)$alkyl or $(C_1\text{-}C_n)$alkenyl having 0, 1, 2, or 3 $(C_1\text{-}C_3)$alkyl branches, wherein when $R^1$ is H, $R^2$ has 1, 2, or 3 $(C_1\text{-}C_3)$alkyl branches, and when $R^1$ is methyl or ethyl, $R^2$ has 0, 1, or 2 $(C_1\text{-}C_3)$alkyl branches, and wherein branching occurs on carbon atoms that are within 40% of the nonfunctionalized terminus of the longest carbon chain;

$R^7$ is $(C_1\text{-}C_{26})$alkyl;

M is $Li^+$, $Na^+$, $K^+$, $Ca^{2+}$, $Mg^{2+}$, and

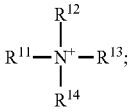

$R^{11}$, $R^{12}$, $R^{13}$, and $R^{14}$ are each independently hydrogen, $(C_1\text{-}C_{22})$alkyl, $(C_1\text{-}C_6)$alkanol, and $(C_1\text{-}C_{22})$alkenyl;

m is 5-37 and n is 1-33, wherein m+n is 6-38; preferably m is 7-27 and n is 1-23, wherein m+n is 8-28.

In one aspect, when $R^1$ is H, $R^2$ has 1, 2, or 3 $(C_1\text{-}C_3)$alkyl branches, and when $R^1$ is methyl or ethyl, $R^2$ has 0, 1, or 2 $(C_1\text{-}C_3)$alkyl branches. Alternatively or additionally, in one aspect, the branching occurs on carbon atoms that are within 40% of the nonfunctionalized terminus of the longest carbon chain. Alternatively or additionally, in yet another aspect, the composition is substantially free of secondary hydroxy compounds.

In another aspect, a suitable anionic surfactant comprises the partially saturated version of the above compounds, wherein an above compound is hydrogenated to provide the partially saturated version thereof.

Suitable anionic surfactants may also include mixtures of at least two compounds of Formula I:

(I)

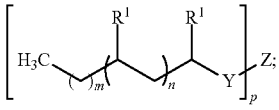

wherein each $R^1$ independently is H or $CH_3$, with the proviso that 1, 2, or 3 $R^1$ is $CH_3$;

m is 1 or 2;

n is 3, 4, 5, 6, 7, 8, or 9;

p is 1, 2, 3, 4, 5, 6, 7, or 8; and,

Y is $CH_2$ or absent, with the proviso that when:

(a) Y is $CH_2$, Z is selected from the group consisting of hydroxyl, an alkoxyl, a sulfate, a disulfate, a sulfonate, a disulfonate, a sulfosuccinate, an amine, a monoalkylamine, a dialkylamine, an amine oxide, a polyhydroxy moiety, a phosphate ester, a polyphosphate ester, a phosphonate, a glycerol ether, a glycerol ether sulfonate, a polygluconate, a monoglycerol ether, a diglyerol ether, a glycerol ether sulfate, a polyglycerol ether, a polyglycerol ether sulfate, a polyglucoside, an ammonioalkanesulfonate, an alkylated quat, an alkyated/hydroxyalkylated quat, an alkylated/polyhydroxyakylated quat, an alkylated/polyhydroxylated oxypropyl quat, a glycol amine quat, a polyoxyalkylene, an alkoxylated sulfate, a pyridinium moiety, a betaine, a sulfobetaine, an aminocarboxylate, an iminodicarboxylate, a phenol ethoxylate, an imidazoline, an O-alkyl ester (i.e., O(C=O)R, wherein R is an alkyl group), and an alkoxylated carboxylate; and, (b) Y is absent, Z is selected from the group consisting of a carboxylic acid, a carboxylate, a glycerol ester sulfonate, a sulfosuccinamate, a glucamide, a taurinate, a sarcosinate, a glycinate, a dialkanolamide, a monoalkanolamide, a monoalkanolamide sulfate, a diglycolamide, a diglycolamide sulfate, a glycerol ester, a glycerol ester sulfate, an amidopropyl betaine, a sugar ester (e.g., a sorbitan ester), a glycerol ester quat, an isethionate, a sulfonated fatty acid, a sulfonated alkyl ester, a C-alkyl ester (i.e., (C═O)OR, wherein R is an alkyl group), an amide, and a polyalkoxylated amidopropyl betaine.

The mixture comprises no more than about 5 wt. %, preferably no more than about 3 wt. %, more preferably no more than about 1 wt. % of compounds that have a longest linear carbon chain of 9 carbon atoms or fewer. Further still, the mixture comprises less than about 50 wt. % of compounds of Formula I that have branching on a carbon atom that is within 40% of the nonfunctionalized terminus of the longest carbon chain, based on the total weight of the mixture.

In some aspects, the mixture of the at least two compounds of Formula I further comprises at least one compound of Formula III:

(III)

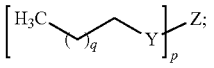

wherein q is 7, 8, 9, 10, 11, 12, 13, 14, 15, 19, 17, 18, 19, or 20;

p is 1, 2, 3, 4, 5, 6, 7, or 8; and,

Y is $CH_2$ or absent, with the proviso that when:

(a) Y is $CH_2$, Z is selected from the group consisting of hydroxyl, an alkoxyl, a sulfate, a disulfate, a sulfonate, a disulfonate, a sulfosuccinate, an amine, a monoalkylamine, a dialkylamine, an amine oxide, a polyhydroxy moiety, a phosphate ester, a polyphosphate ester, a phosphonate, a glycerol ether, a glycerol ether sulfonate, a polygluconate, a monoglycerol ether, a diglyerol ether, a glycerol ether sulfate, a polyglycerol ether, a polyglycerol ether sulfate, a polyglucoside, an ammonioalkanesulfonate, an alkylated quat, an alkyated/hydroxyalkylated quat, an alkylated/polyhydroxyakylated quat, an alkylated/polyhydroxylated oxypropyl quat, a glycol amine quat, a polyoxyalkylene, an alkoxylated sulfate, a pyridinium moiety, a betaine, a sulfobetaine, an aminocarboxylate, an iminodicarboxylate, a phenol ethoxylate, an imidazoline, an O-alkyl ester, and an alkoxylated carboxylate; and, (b) Y is absent, Z is selected from the group consisting of a carboxylic acid, a carboxylate, a glycerol ester sulfonate, a sulfosuccinamate, a glucamide, a taurinate, a sarcosinate, a glycinate, a dialkanolamide, a monoalkanolamide, a monoalkanolamide sulfate, a diglycolamide, a diglycolamide sulfate, a glycerol ester, a glycerol ester sulfate, an amidopropyl betaine, a sugar ester, a glycerol ester quat, an isethionate, a sulfonated fatty acid, a sulfonated alkyl ester, a C-alkyl ester, an amide, and a polyalkoxylated amidopropyl betaine.

The at least one compound of Formula III is present in the mixture in an amount of at least about 1 wt. %, at least about 10 wt. %, at least about 30 wt. %, at least about 50 wt. %, at least about 70 wt. %, at least about 80 wt. %, at least about 90 wt. %, or at least about 95 wt. %, based on the total weight of the mixture. For example, the at least one compound of Formula III can be present in the mixture in an amount of about 1 wt. % to about 95 wt. %, based on the total weight of the mixture.

In some aspects, the

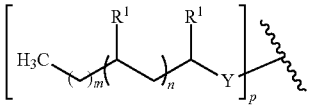

component of the at least two compounds of Formula I has a biobased content of at least about 50%, at least about 60%, at least about 70%, at least about 80%, at least about 90%, at least about 95%, at least about 97%, or about 100%.

In some aspects, the at least one compound of Formula I contains a methyl branch at a position selected from the group consisting of the 2-, 4-, 6-, 8-, 10-, 12-, or 14-position. In some aspects, a compound of Formula I contains one methyl branch. In these aspects, the one methyl branch is at a position selected from the group consisting of the 2-, 4-, 6-, 8-, 10-, 12-, or 14-position.

In another aspect, a suitable anionic surfactant comprises a mixture of at least two compounds of Formula I, as previously described, wherein the mixture is produced by (a) culturing a cell comprising:

(i) an exogenous or overexpressed polynucleotide comprising a nucleic acid sequence encoding a polypeptide that catalyzes the conversion of propionyl-CoA to methylmalonyl-CoA; and/or, (ii) an exogenous or overexpressed polynucleotide comprising a nucleic acid sequence encoding a polypeptide that catalyzes the conversion of succinyl-CoA to methylmalonyl-CoA, under conditions allowing expression of the polynucleotide(s) and production a mixture of at least two compounds of Formula II:

(II)

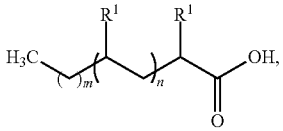

wherein the cell produces more compounds of Formula II than an otherwise similar cell that does not comprise the polynucleotide(s);

(b) extracting from culture the mixture of at least two compounds of Formula II; and, (c) derivatizing the compounds of Formula (II) to form the mixture of at least two compounds of Formula I.

Additional suitable anionic surfactants include branched fatty alcohols with C6- to C15-residues such as those sold under the trade names Safol 23, Marlipal 013, Isalchem 123, Isalchem 125 and Marlipal 031.

Nonionic Surfactants

In addition to the anionic surfactant component, the liquid cleaning compositions of the present invention may further comprise a nonionic surfactant. The liquid cleaning compositions may comprise up to about 10%, by weight of the surfactant system, of one or more nonionic surfactants. In some examples, the liquid cleaning compositions may comprise from about 0.01% to about 10%, by weight of the surfactant system, of one or more nonionic surfactants. In further examples, the liquid cleaning compositions may comprise from about 0.1% to about 10%, by weight of the surfactant system, of one or more nonionic surfactants.

Suitable nonionic surfactants useful herein can comprise any conventional nonionic surfactant typically used in liquid and/or solid detergent products. These can include, e.g., alkoxylated fatty alcohols and amine oxide surfactants. Preferred for use in the liquid cleaning compositions disclosed herein are those nonionic surfactants which are normally liquid.

In some examples, the liquid cleaning compositions may comprise from about 0.01% to about 5%, or from about 0.01% to about 4%, by weight of the composition, of an ethoxylated nonionic surfactant. These materials are described in U.S. Pat. No. 4,285,841, Banat et al, issued Aug. 25, 1981. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981. In one example, the nonionic surfactant is selected from ethoxylated alcohols having an average of about 24 carbon atoms in the alcohol and an average degree of ethoxylation of about 9 moles of ethylene oxide per mole of alcohol.

Without being limited by theory, it is believed that the addition of an ethoxylated nonionic surfactant to the cleaning compositions of the invention herein is helpful in providing physical stability to the detergent product, i.e., preventing phase splits and precipitation. In addition, it is believed that the presence of alkyl ethoxylate nonionic surfactants in liquid cleaning compositions can reduce the irritancy commonly associated with anionic surfactants. This irritancy reduction is especially advantageous for liquid cleaning compositions being used as shampoos, and not just as laundry detergents.

Other non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1 to 30, as discussed in U.S. Pat. Nos. 6,153,577, 6,020,303 and 6,093,856; Alkylpolysaccharides as discussed in U.S. Pat. No. 4,565,647 to Llenado, issued Jan. 26, 1986; specifically alkylpolyglycosides as discussed in U.S. Pat. Nos. 4,483,780 and 4,483,779; Polyhydroxy fatty acid amides as discussed in U.S. Pat. No. 5,332,528, WO 92/06162, WO 93/19146, WO 93/19038, and WO 94/09099; and ether capped poly(oxyalkylated) alcohol surfactants as discussed in U.S. Pat. No. 6,482,994 and WO 01/42408.

Anionic/Nonionic Combinations

In the liquid cleaning compositions described herein, the surfactant system may comprise combinations of anionic and nonionic surfactant materials. When this is the case, in some examples, the weight ratio of anionic surfactant to nonionic surfactant may be at least about 2:1. In other examples, the weight ratio of anionic surfactant to nonionic surfactant may be at least about 5:1. In further examples, the weight ratio of anionic surfactant to nonionic surfactant may be at least about 10:1.

Cationic Surfactant

The liquid cleaning compositions are, in some examples, substantially free of cationic surfactants and surfactants that become cationic below a pH of 7, alternatively below a pH of 6. Cationic surfactants are known to form precipitates with anionic surfactants. The presence of cationic-anionic surfactant precipitate is evident in the formation of turbid/cloudy (not clear) formulations that physically separate. To stabilize these formulations, it is necessary to reduce anionic surfactant and to increase nonionic surfactant to control separation of the cationic-anionic surfactant precipitates. Without being limited by theory, it is believed that cationic surfactants may be used herein to provide fabric softening and/or antistatic benefits.

Cationic surfactants are well known in the art and examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006, which is herein incorporated by reference; d) cationic ester surfactants as discussed in U.S. Pat. Nos. 4,228,042, 4,239,660 4,260,529 and 6,022,844, which is herein incorporated by reference; and e) amino surfactants as discussed in U.S. Pat. No. 6,221,825 and WO 00/47708, which is herein incorporated by reference, and specifically amido propyldimethyl amine (APA). Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Amphoteric Surfactants

Examples of amphoteric surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. Examples of compounds falling within this definition are sodium 3-(dodecylamino)propionate, sodium 3-(dodecylamino)propane-1-sulfonate, sodium 2-(dodecylamino)ethyl sulfate, sodium 2-(dimethylamino)octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. See U.S. Pat. No. 3,929,678 to Laughlin et al., issued Dec. 30, 1975 at column 19, lines 18-35, for examples of amphoteric surfactants.

Zwitterionic Surfactants

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants; betaine, including alkyl dimethyl betaine and cocodimethyl amidopropyl betaine, $C_8$-$C_{18}$ (and in some examples $C_{12}$-$C_{18}$) amine oxides and sulfo and hydroxy betaines, such as N-alkyl-N,N-dimethylammino-1-propane sulfonate where the alkyl group can be $C_8$-$C_{18}$, and in some examples, $C_{10}$-$C_{14}$.

Branched Surfactants

Other surfactants useful herein include branched surfactants, such as those disclosed in the U.S. Pat. Nos. 8,044, 249, 7,994,369, US Patent Application No. 2012/0010423, US Patent Application No. 2011/0034363, US Patent Application No. 2012/0010432, and US Patent Application No. 2011/0166370.

Cleaning Enzyme

One or more cleaning enzymes are included in liquid cleaning compositions described herein. The enzymes should be selected from those that are compatible with an acidic environment, including, e.g., proteases, amylases, and mixtures thereof. Enzymes are normally incorporated into cleaning compositions at levels sufficient to provide a "cleaning-effective amount." The term "cleaning effective amount" refers to any amount capable of producing a cleaning, stain removal, soil removal, whitening, or freshness improving effect on the treated substrate. The enzymes may be incorporated into the cleaning composition at levels from about 0.0001% to about 5% of active enzyme by weight of the cleaning composition. In some examples, the enzymes are incorporated into the cleaning composition at levels from about 0.0005% to about 3% of active enzyme by weight of the cleaning composition. In further examples, the enzymes are incorporated into the cleaning composition at levels from about 0.001% to about 2% of active enzyme by weight of the cleaning composition. The compositions herein comprise enzymes at levels sufficient to provide up to about 10 mg by weight, more typically about 0.01 mg to about 6 mg, of active enzyme per gram of the composition. The enzymes can be added as separate single ingredient or as mixtures of two or more enzymes.

A range of enzyme materials and means for their incorporation into synthetic cleaning compositions is disclosed in WO 93/07263A and WO 93/07260A to Genencor International, WO 89/08694A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981.

Amylase

The cleaning compositions disclosed herein may comprise a α-amylase enzyme. Non-limiting examples of α-amylases that may be used herein are described in WO 97/32961, which is incorporated herein by reference, as "specific amylase enzymes." These amylases include:

(a) α-amylases according (a) comprising the amino sequence shown in SEQ ID NO. 1 of WO 97/32961 or an α-amylase being at least 80% homologous with the amino acid sequence shown in SEQ ID NO. 1;

(b) α-amylases according (a) comprising the amino sequence shown in SEQ ID NO. 2 of WO 97/32961 or an α-amylase being at least 80% homologous with the amino acid sequence shown in SEQ ID NO. 2;

(c) α-amylases comprising the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp (see, e.g., SEQ ID NO. 3 of WO 97/32961) or an α-amylase being at least 80% homologous with the amino acid sequence shown in SEQ ID NO. 3 of WO 97/32961 in the N-terminal. A polypeptide is considered to be X % homologous to the parent amylase if a comparison of the respective amino acid sequences, performed via algorithms, such as the one described by Lipman and Pearson in Science 227, 1985, p. 1435, reveals an identity of X %;

(d) α-amylases according (a-c) wherein the α-amylase is obtainable from a *Bacillus* species. In some examples, the α-amylase is obtainable from any of the *Bacillus* strains NCIB 12289, NCIB 12512, NCIB 12513 and DSM 935. The term "obtainable from" is intended not only to indicate an amylase produced by a *Bacillus* strain but also an amylase encoded by a DNA sequence isolated from such a *Bacillus* strain and produced in an host organism transformed with said DNA sequence;

(e) α-amylase showing positive immunological cross-reactivity with antibodies raised against an α-amylase having an amino acid sequence corresponding respectively to SEQ ID NO. 1, SEQ ID NO. 2 or SEQ ID NO. 3 of WO 97/32961; and (f) Variants of the following parent α-amylases which (i) have one of the amino acid sequences shown in SEQ ID NO. 1, SEQ ID NO. 2 or SEQ ID NO. 4 of WO 97/32961 respectively, or (ii) displays at least 80% homology with one or more of said amino acid sequences, and/or displays immunological cross-reactivity with an antibody raised against an α-amylase having one of said amino acid sequences, and/or is encoded by a DNA sequence which hybridizes with the same probe as a DNA sequence encoding an α-amylase having one of said amino acid sequence; in which variants:

1. at least one amino acid residue of said parent α-amylase has been deleted; and/or
2. at least one amino acid residue of said parent α-amylase has been replaced by a different amino acid residue; and/or
3. at least one amino acid residue has been inserted relative to said parent α-amylase; said variant having an α-amylase activity and exhibiting at least one of the following properties relative to said parent α-amylase: increased thermostability, increased stability towards oxidation, reduced Ca ion dependency, increased stability and/or α-amylolytic activity at neutral to relatively high pH values, increased α-amylolytic activity at relatively high temperature and increase or decrease of the isoelectric point (pI) so as to better match the pI value for α-amylase variant to the pH of the medium. Said variants are described in WO 96/23873 and U.S. Pat. No. 6,093,562, issued Jul. 25, 2000, both of which are incorporated herein by reference.

In some examples, the α-amylase is selected from Duramyl®, Fungamyl® or Natalase® produced by Novozymes. In other examples, the α-amylase is selected from Natalase®, which has an amino acid sequence shown in SEQ. ID NO. 2 in WO 97/32961. The α-amylase may be present in the composition at levels of about 0.0001% to about 5%, by weight of the composition, of α-amylase. In some examples, the α-amylase is present in the cleansing composition at a level of from about 0.01% to about 1%, by weight of the composition. In other examples, the α-amylase is present in the cleansing composition at a level of from about up to about 5 mg of active enzyme per gram of the composition. In further examples, the α-amylase is present in the cleansing composition at a level of from about 0.01 mg to 3 mg, of active enzyme per gram of the household cleaning composition.

Protease

The cleaning compositions disclosed herein may comprise a protease enzyme. Non-limiting examples of suitable proteases include proteases obtained from: subtilisins, which are obtained from particular strains of *B. subtilis* and *B.*

*licheniformis* (subtilisin BPN and BPN'), and *Bacillus* strains developed and sold as ESPERASE® by Novo Industries A/S of Denmark, hereinafter "Novo". The preparation of this enzyme and analogous enzymes is described in GB 1,243,784 to Novo. Other non-limiting examples of suitable proteases include ALCALASE®, DURAZYM® and SAVINASE® from Novo and MAXATASE®, MAXACAL®, PROPEPASE® and MAXAPEM® (protein engineered Maxacal) from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. Examples of enzymatic detergents comprising protease, one or more other enzymes, and a reversible protease inhibitor are described in WO 92/03529 A to Novo. Other examples of suitable proteases include those of WO 95/10591 A to Procter & Gamble. When desired, a protease having decreased adsorption and increased hydrolysis is available as described in WO 95/07791 to Procter & Gamble. A recombinant trypsin-like protease for detergents is also described in WO 94/25583 to Novo. Examples of acid proteases include Promod® 24L, 144L and 671 L produced by Biocatalysts, and Protease A and Protease B produced by Amano and GC 106 and Fungal Acid Protease 500000 produced by Genencor. Other acid proteases are disclosed in U.S. Pat. No. 6,376,449.

In some examples, the protease is present in the cleansing composition at a level of from about 0.001% to about 5% by weight of the composition. In other examples, the protease is present in the cleansing composition at a level of from about 0.01% to about 1% by weight of the composition. In further examples, the protease is present in the cleansing composition at a level of from about protease is present in the cleansing composition at a level of from about up to about 2 mg of active enzyme per gram of the composition. In further examples, the protease is present in the cleansing composition at a level of from about 0.01 mg to 1 mg, of active enzyme per gram of the household cleaning composition.

Other Cleaning Enzymes

Other enzymes that provide cleaning performance and/or fabric care benefits may be used in the cleaning compositions described herein. Examples includes enzymes from the class of cellulases, hemicellulases, peroxidases, proteases, gluco-amylases, amylases, xylanases, lipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase or mixtures thereof.

Examples of suitable cellulases are disclosed in U.S. Pat. No. 4,435,307, WO 91/17243, GB-A-2,075,028; GB-A-2,095,275, DE-OS-2,247,832, European patent application No. 91202879.2, filed Nov. 6, 1991 (Novo), and can include Carezyme and Celluzyme (Novo Nordisk A/S). Non-limiting examples of peroxidase enzymes can include, horseradish peroxidase, ligninase, laccase and haloperoxidase, and are further disclosed in, for example, WO 89/099813, WO 89/09813 and in European Patent applications EP No. 91202882.6, filed on Nov. 6, 1991 and EP No. 96870013.8, filed Feb. 20, 1996. Examples of suitable lipase enzymes are disclosed in British Patent 1,372,034. Other suitable lipases are available from Amano Pharmaceutical Co. Ltd., Nagoya, Japan, under the trade name Lipase P "Amano," hereinafter referred to as "Amano-P," Amano-CES, Chromobacter viscosum lipases from Toyo Jozo Co., Tagata, Japan, U.S. Biochemical Corp., U.S.A., or Disoynth Co., The Netherlands, M1 Lipase R and Lipomax R (Gist-Brocades), and Lipolase R and Lipolase Ultra R (Novo). Examples of suitable cutinases [EC 3.1.1.50] are described in WO-A-88/09367 (Genencor).

Fatty Acids

The cleaning compositions described herein may comprise from about 1% to about 5%, by weight of the composition, of fatty acid components to provide builder activity. In some examples, the cleaning compositions may comprise from about 1.5% to about 3%, by weight of the composition, of fatty acid components. Examples of fatty acids include linear and branched, saturated and mono- and polyunsaturated carboxylic acids having from 8 to 22 carbon atoms and their salts. In some examples, the fatty acid may be a $C_{12}$-$C_{18}$ fatty acid.

In some aspects, the compositions of the present invention may comprise from about 5% to about 40%, preferably from about 7% to about 30%, most preferably from about 10% to about 20%, by weight of a fatty acid comprising from about 10 to about 22 carbon atoms. The fatty acid can also comprise from about 1 to about 10 ethylene oxide units in the hydrocarbon chain.

Other Adjunct Cleaning Additives

The cleaning compositions described herein may also comprise additional adjunct cleaning additives. The precise nature of these additional components and levels of incorporation thereof will depend on the physical form of the composition, and the precise nature of the cleaning operation for which it is to be used.

The adjunct cleaning additives may be selected from the group consisting of builders, structurants or thickeners, clay soil removal/anti-redeposition agents, polymeric soil release agents, polymeric dispersing agents, polymeric grease cleaning agents, enzymes, enzyme stabilizing systems, bleaching compounds, bleaching agents, bleach activators, bleach catalysts, brighteners, dyes, fabric hueing agents, dye transfer inhibiting agents, chelating agents, suds suppressors, fabric softeners, and perfumes.

The adjunct cleaning additives may alternatively be selected from the group consisting of conditioning ingredients, humectants, suspending agents, skin care actives, and anti-dandruff actives.

This listing of such ingredients is exemplary only, and not by way of limitation of the types of ingredients which can be used with surfactants systems herein. A detailed description of additional components can be found in U.S. Pat. No. 6,020,303.

Chelating Agents

The cleaning compositions described herein may also optionally contain one or more iron and/or manganese and/or other metal ion chelating agents. Such chelating agents can be selected from the group consisting of amino carboxylates, amino phosphonates, polyfunctionally-substituted aromatic chelating agents and mixtures therein. If utilized, these chelating agents may comprise from about 0.1% to about 15% by weight of the cleaning compositions herein. In some examples, if utilized, the chelating agents may comprise from about 0.1% to about 3.0% by weight of such compositions.

The chelant or combination of chelants may be chosen by one skilled in the art to provide for heavy metal (e.g. Fe) sequestration without negatively impacting enzyme stability through the excessive binding of calcium ions. Non-limiting examples of chelants of use in the present invention may be found in U.S. Pat. Nos. 7,445,644, 7,585,376 and U.S. Publication 2009/0176684A1.

Examples of useful chelants may include heavy metal chelating agents, such as diethylenetriaminepentaacetic acid (DTPA) and/or a catechol including, but not limited to, Tiron. In some examples in which a dual chelant system is used, the chelants may be DTPA and Tiron.

DTPA has the following core molecular structure:

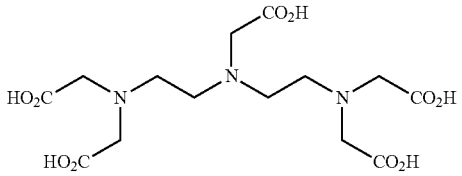

Tiron, also known as 1,2-diydroxybenzene-3,5-disulfonic acid, is one member of the catechol family and has the core molecular structure shown below:

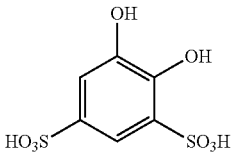

Other sulphonated catechols may be used. In addition to the disulfonic acid, the term "Tiron" may also include mono- or di-sulfonate salts of the acid, such as, for example, the disodium sulfonate salt, which shares the same core molecular structure with the disulfonic acid.

Examples of other chelating agents suitable for use herein can be selected from the group consisting of aminocarboxylates, aminophosphonates, polyfunctionally-substituted aromatic chelating agents and mixtures thereof. In some examples, suitable chelants may include, but are not limited to: HEDP (hydroxyethanedimethylenephosphonic acid); MGDA (methylglycinediacetic acid); and mixtures thereof.

Without intending to be bound by theory, it is believed that the benefit of these materials is due in part to their exceptional ability to remove heavy metal ions from washing solutions by formation of soluble chelates; other benefits include inorganic film or scale prevention. Other suitable chelating agents for use herein are the commercial DEQUEST series, and chelants from Monsanto, DuPont, and Nalco, Inc.

Aminocarboxylates useful as chelating agents include, but are not limited to, ethylenediaminetetracetates, N-(hydroxyethyl)ethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts thereof and mixtures thereof. Aminophosphonates are also suitable for use as chelating agents in the compositions described herein when at least low levels of total phosphorus are permitted in cleaning compositions, and include ethylenediaminetetrakis (methylenephosphonates). In some examples, these aminophosphonates do not contain alkyl or alkenyl groups with more than about 6 carbon atoms. Polyfunctionally-substituted aromatic chelating agents are also useful in the compositions herein. See U.S. Pat. No. 3,812,044. In some examples, useful polyfunctionally-substituted aromatic chelating agents in acid form are dihydroxydisulfobenzenes such as 1,2-dihydroxy-3,5-disulfobenzene.

A biodegradable chelator that may also be used herein is ethylenediamine disuccinate ("EDDS"). In some examples, but of course not limited to this particular example, the [S,S] isomer as described in U.S. Pat. No. 4,704,233 may be used. In other examples, the trisodium salt of EDDA may be used, though other forms, such as magnesium salts, may also be useful.

Builders

The cleaning compositions described herein may optionally comprise a builder. Built detergents may comprise at least about 1 wt % builder, based on the total weight of the composition. Liquid formulations may comprise up to about 10 wt %, and in some examples up to 8 wt % of builder to the total weight of the composition.

Detergent builders, when used may be selected from aluminosilicates and silicates, to assist in controlling mineral, especially calcium and/or magnesium, hardness in wash water or to assist in the removal of particulate soils from surfaces. Examples of suitable builders can be selected from the group consisting of phosphates and polyphosphates, including the sodium salts; carbonates, bicarbonates, sesquicarbonates and carbonate minerals other than sodium carbonate or sesquicarbonate; organic mono-, di-, tri-, and tetracarboxylates, including water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, including sodium sulfate and any other fillers or carriers which may be important to the engineering of stable surfactant and/or builder-containing cleaning compositions. Other detergent builders can be selected from the polycarboxylate builders, for example, copolymers of acrylic acid, copolymers of acrylic acid and maleic acid, and copolymers of acrylic acid and/or maleic acid and other suitable ethylenic monomers with various types of additional functionalities. Also suitable for use as builders herein are synthesized crystalline ion exchange materials or hydrates thereof having chain structure and a composition represented by the following general Formula I an anhydride form: $x(M_2O).ySiO_2.zM'O$, wherein M is Na and/or K, M' is Ca and/or Mg; y/x is 0.5 to 2.0 and z/x is 0.005 to 1.0 as taught in U.S. Pat. No. 5,427,711.

However, it has also been found that the isoprenoid-based Target A and Target B surfactants are particularly suited to performing well in unbuilt conditions. Therefore, lower levels of builders, including especially detergents having less than 1% by weight, and in particular builders that are essentially free of builders are of special relevance to the cleaning compositions described herein. By "essentially free" it is meant that no builders are intentionally added to the desired cleaning composition.

Structurant/Thickeners

Structured liquids can either be internally structured, whereby the structure is formed by primary ingredients (e.g. surfactant material) and/or externally structured by providing a three dimensional matrix structure using secondary ingredients (e.g. polymers, clay and/or silicate material). The composition may comprise from about 0.01% to about 5%, by weight of the composition, of a structurant, and in some examples, from about 0.1% to about 2.0%, by weight of the composition, of a structurant. The structurant may be selected from the group consisting of diglycerides and triglycerides, ethylene glycol distearate, microcrystalline cellulose, cellulose-based materials, microfiber cellulose, biopolymers, xanthan gum, gellan gum, and mixtures thereof. In some examples, a suitable structurant includes hydrogenated castor oil, and non-ethoxylated derivatives thereof. Other suitable structurants are disclosed in U.S. Pat. No. 6,855,680. Such structurants have a thread-like structuring system having a range of aspect ratios. Further suitable structurants and the processes for making them are described in WO 2010/034736.

Clay Soil Removal/Anti-Redeposition Agents

The cleaning compositions described herein may also optionally contain water-soluble ethoxylated amines having clay soil removal and anti-redeposition properties. The composition may contain about 0.01% to about 5% by weight of the composition, of a clay soil removal/anti-redeposition agent.

An example of a soil suspending and/or anti-redeposition agent is ethoxylated tetraethylenepentamine. Ethoxylated amines are further described in U.S. Pat. No. 4,597,898, issued Jul. 1, 1986. Other soil suspending/anti-redeposition agents include the cationic compounds disclosed in European Patent Application 111,965, published Jun. 27, 1984, ethoxylated amine polymers as disclosed in European Patent Application 111,984, published Jun. 27, 1984; zwitterionic polymers as disclosed in European Patent Application 112,592, published Jul. 4, 1984; and amine oxides as disclosed in U.S. Pat. No. 4,548,744, issued Oct. 22, 1985. Other examples of an anti-redeposition agent include carboxymethyl cellulose (CMC) materials or hydroxypropyl methyl celluloses (HPMC). Of course, other suitable soil suspending and/or anti redeposition agents that may be utilized in the cleaning compositions will be apparent to those of ordinary skill in the art in view of the teachings herein.

Polymeric Soil Release Agent

Known polymeric soil release agents, hereinafter "SRA" or "SRAs," can optionally be employed in the cleaning compositions described herein. If utilized, SRAs may comprise from about 0.01% to about 10.0% by weight of the composition, in some examples, from about 0.1% to about 5% by weight of the composition, and in other examples from about 0.2% to about 3.0% by weight of the composition.

SRAs may have hydrophilic segments to hydrophilize the surface of hydrophobic fibers such as polyester and nylon, and hydrophobic segments to deposit upon hydrophobic fibers and remain adhered thereto through completion of washing and rinsing cycles thereby serving as an anchor for the hydrophilic segments. This can enable stains occurring subsequent to treatment with SRA to be more easily cleaned in later washing procedures.

SRAs can also include, for example, a variety of charged, e.g., anionic or even cationic (see U.S. Pat. No. 4,956,447), as well as non-charged monomer units and structures may be linear, branched or even star-shaped. They may include capping moieties which are especially effective in controlling molecular weight or altering the physical or surface-active properties. Structures and charge distributions may be tailored for application to different fiber or textile types and for varied detergent or detergent additive products. Examples of SRAs are described in U.S. Pat. Nos. 4,968,451; 4,711,730; 4,721,580; 4,702,857; 4,877,896; 3,959,230; 3,893,929; 4,000,093; 5,415,807; 4,201,824; 4,240,918; 4,525,524; 4,201,824; 4,579,681; and 4,787,989; European Patent Application 0 219 048; 279,134 A; 457,205 A; and DE 2,335,044.

Polymeric Dispersing Agents

Polymeric dispersing agents can be utilized at levels of from about 0.1% to about 7%, by weight, in the compositions described herein, and in some examples, in the presence of zeolite and/or layered silicate builders. Suitable polymeric dispersing agents include polymeric polycarboxylates and polyethylene glycols, although others known in the art can also be used. For example, a wide variety of modified or unmodified polyacrylates, polyacrylate/maleates, or polyacrylate/methacrylates are highly useful. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition. Examples of polymeric dispersing agents are found in U.S. Pat. No. 3,308,067, European Patent Application No. 66915, EP 193,360, and EP 193,360.

Alkoxylated Polyamine Polymers

Soil suspension, grease cleaning, and particulate cleaning polymers may include the alkoxylated polyamines. Such materials include, but are not limited to, ethoxylated polyethyleneimine, ethoxylated hexamethylene diamine, and sulfated versions thereof. Polypropoxylated derivatives may also be included. A wide variety of amines and polyalkyleneimines can be alkoxylated to various degrees, and optionally further modified to provide the abovementioned benefits. A useful example is 600 g/mol polyethyleneimine core ethoxylated to 20 EO groups per NH and is available from BASF.

Polymeric Grease Cleaning Polymers

Alkoxylated polycarboxylates such as those prepared from polyacrylates are useful herein to provide additional grease removal performance. Such materials are described in WO 91/08281 and PCT 90/01815. Chemically, these materials comprise polyacrylates having one ethoxy side-chain per every 7-8 acrylate units. The side-chains are of the formula $—(CH_2CH_2O)_m(CH_2)_nCH_3$ wherein m is 2-3 and n is 6-12. The side-chains are ester-linked to the polyacrylate "backbone" to provide a "comb" polymer type structure. The molecular weight can vary, but may be in the range of about 2000 to about 50,000. Such alkoxylated polycarboxylates can comprise from about 0.05% to about 10%, by weight of the compositions described herein.

The isoprenoid-derived surfactants of the present invention, and their mixtures with other cosurfactants and other adjunct ingredients, are particularly suited to be used with an amphilic graft co-polymer. In some examples, the amphilic graft co-polymer comprises (i) polyethylene glycol backbone; and (ii) and at least one pendant moiety selected from polyvinyl acetate, polyvinyl alcohol and mixtures thereof. In other examples, the amphilic graft co-polymer is Sokalan HP22, supplied from BASF.

Enzyme Stabilizing System

The enzyme-containing compositions described herein may optionally comprise from about 0.001% to about 10%, by weight of the composition, of an enzyme stabilizing system, in some examples from about 0.005% to about 8%, by weight of the composition, of an enzyme stabilizing system, and in other examples, from about 0.01% to about 6%, by weight of the composition, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, chlorine bleach scavengers and mixtures thereof, and are designed to address different stabilization problems depending on the type and physical form of the cleaning composition. See U.S. Pat. No. 4,537,706 for a review of borate stabilizers.

Bleaching Compounds, Bleaching Agents, Bleach Activators, and Bleach Catalysts

The cleaning compositions described herein may contain bleaching agents or bleaching compositions containing a bleaching agent and one or more bleach activators. Bleaching agents may be present at levels of from about 1 wt % to about 30 wt %, and in some examples, from about 5 wt % to about 20 wt %, based on the total weight of the composition. If present, the amount of bleach activators may be from about 0.1 wt % to about 60 wt %, and in some examples, from about 0.5 wt % to about 40 wt % of the bleaching composition comprising the bleaching agent-plus-bleach activator.

Examples of bleaching agents include oxygen bleach, perborate bleach, percarboxylic acid bleach and salts thereof, peroxygen bleach, persulfate bleach, percarbonate bleach, and mixtures thereof. Examples of bleaching agents are disclosed in U.S. Pat. No. 4,483,781, U.S. patent application Ser. No. 740,446, European Patent Application 0,133, 354, U.S. Pat. Nos. 4,412,934, and 4,634,551.

Examples of bleach activators (e.g., acyl lactam activators) are disclosed in U.S. Pat. Nos. 4,915,854; 4,412,934; 4,634,551; 4,634,551; and 4,966,723.

In some examples, the cleaning composition comprises a transition metal bleach catalyst. In other examples, the transition metal bleach catalyst may be encapsulated. The transition metal bleach catalyst may comprise a transition metal ion, selected from transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV), more preferably Mn(II), Mn(III), Mn(IV), Fe(II), Fe(III), Cr(II), Cr(III), Cr(IV), Cr(V), and Cr(VI). The transition metal bleach catalyst may comprise a ligand, in some examples, a macropolycyclic ligand, and in other examples, a cross-bridged macropolycyclic ligand. The transition metal ion may be coordinated with the ligand. In some examples, the ligand comprises at least four donor atoms, at least two of which are bridgehead donor atoms. Examples of suitable transition metal bleach catalysts are described in U.S. Pat. Nos. 5,580,485, 4,430,243; 4,728,455; 5,246,621; 5,244, 594; 5,284,944; 5,194,416; 5,246,612; 5,256,779; 5,280, 117; 5,274,147; 5,153,161; 5,227,084; 5,114,606; 5,114,611, EP 549,271 A1; EP 544,490 A1; EP 549,272 A1; and EP 544,440 A2. A suitable transition metal bleach catalyst is a manganese-based catalyst, for example disclosed in U.S. Pat. No. 5,576,282. Suitable cobalt bleach catalysts are described, for example, in U.S. Pat. Nos. 5,597,936 and 5,595,967. Such cobalt catalysts may be prepared by known procedures, such as those taught in, for example, U.S. Pat. Nos. 5,597,936, and 5,595,967. A suitable transition metal bleach catalyst is a transition metal complex of ligand such as bispidones described in WO 05/042532 A1.

Bleaching agents other than oxygen bleaching agents are also known in the art and can be utilized herein include, for e.g., photoactivated bleaching agents such as the sulfonated zinc and/or aluminum phthalocyanines (U.S. Pat. No. 4,033, 718, incorporated herein by reference), or pre-formed organic peracids, such as peroxycarboxylic acid or salt thereof, or a peroxysulphonic acid or salt thereof. A suitable organic peracid is phthaloylimidoperoxycaproic acid. If used, the cleaning compositions described herein may contain from about 0.025% to about 1.25%, by weight of the composition, of such bleaches, and in some examples, of sulfonate zinc phthalocyanine.

Brighteners

Optical brighteners or other brightening or whitening agents may be incorporated at levels of from about 0.01% to about 1.2%, by weight of the composition, into the cleaning compositions described herein. Commercial optical brighteners, which may be used herein, can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents," M. Zahradnik, John Wiley & Sons, New York (1982). Specific non-limiting examples of optical brighteners which are useful in the present compositions are those identified in U.S. Pat. Nos. 4,790,856 and 3,646,015.

Fabric Hueing Agents

The composition may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. In another aspect, suitable small molecule dyes include small molecule dyes selected from the group consisting of Colour Index (Society of Dyers and Colourists, Bradford, UK) numbers Direct Violet dyes such as 9, 35, 48, 51, 66, and 99, Direct Blue dyes such as 1, 71, 80 and 279, Acid Red dyes such as 17, 73, 52, 88 and 150, Acid Violet dyes such as 15, 17, 24, 43, 49 and 50, Acid Blue dyes such as 15, 17, 25, 29, 40, 45, 75, 80, 83, 90 and 113, Acid Black dyes such as 1, Basic Violet dyes such as 1, 3, 4, 10 and 35, Basic Blue dyes such as 3, 16, 22, 47, 66, 75 and 159, Disperse or Solvent dyes such as those described in EP1794275 or EP1794276, or dyes as disclosed in U.S. Pat. No. 7,208,459 B2, and mixtures thereof. In another aspect, suitable small molecule dyes include small molecule dyes selected from the group consisting of C. I. numbers Acid Violet 17, Direct Blue 71, Direct Violet 51, Direct Blue 1, Acid Red 88, Acid Red 150, Acid Blue 29, Acid Blue 113 or mixtures thereof.

Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof. Polymeric dyes include those described in WO2011/98355, WO2011/47987, US2012/090102, WO2010/145887, WO2006/055787 and WO2010/142503.

In another aspect, suitable polymeric dyes include polymeric dyes selected from the group consisting of fabric-substantive colorants sold under the name of Liquitint® (Milliken, Spartanburg, S.C., USA), dye-polymer conjugates formed from at least one reactive dye and a polymer selected from the group consisting of polymers comprising a moiety selected from the group consisting of a hydroxyl moiety, a primary amine moiety, a secondary amine moiety, a thiol moiety and mixtures thereof. In still another aspect, suitable polymeric dyes include polymeric dyes selected from the group consisting of Liquitint® Violet CT, carboxymethyl cellulose (CMC) covalently bound to a reactive blue, reactive violet or reactive red dye such as CMC conjugated with C.I. Reactive Blue 19, sold by Megazyme, Wicklow, Ireland under the product name AZO-CM-CELLULOSE, product code S-ACMC, alkoxylated triphenylmethane polymeric colourants, alkoxylated thiophene polymeric colourants, and mixtures thereof.

Preferred hueing dyes include the whitening agents found in WO 08/87497 A1, WO2011/011799 and WO2012/054835. Preferred hueing agents for use in the present invention may be the preferred dyes disclosed in these references, including those selected from Examples 1-42 in Table 5 of WO2011/011799. Other preferred dyes are disclosed in U.S. Pat. No. 8,138,222. Other preferred dyes are disclosed in WO2009/069077.

Suitable dye clay conjugates include dye clay conjugates selected from the group comprising at least one cationic/basic dye and a smectite clay, and mixtures thereof. In another aspect, suitable dye clay conjugates include dye clay conjugates selected from the group consisting of one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11, and a clay selected from the group consisting of Montmorillonite clay, Hectorite clay, Saponite clay and mixtures thereof. In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by C1-C3-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

In another aspect, suitable pigments include pigments selected from the group consisting of Ultramarine Blue (C.I. Pigment Blue 29), Ultramarine Violet (C.I. Pigment Violet 15) and mixtures thereof.

The aforementioned fabric hueing agents can be used in combination (any mixture of fabric hueing agents can be used).

Dye Transfer Inhibiting Agents

The cleaning compositions described herein may also include one or more materials effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may comprise from about 0.01% to about 10% by weight of the composition, in some examples, from about 0.01% to about 5% by weight of the composition, and in other examples, from about 0.05% to about 2% by weight of the composition.

Suds Suppressors

Compounds for reducing or suppressing the formation of suds can be incorporated into the compositions described herein. Suds suppression can be of particular importance in the so-called "high concentration cleaning process" as described in U.S. Pat. Nos. 4,489,455 and 4,489,574, and in front-loading-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430-447 (John Wiley & Sons, Inc., 1979). Examples of suds suppressors include monocarboxylic fatty acid and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons preferably having a melting point below about 100° C., silicone suds suppressors, and secondary alcohols. Suds suppressors are described in U.S. Pat. Nos. 2,954,347; 4,265,779; 4,265,779; 3,455,839; 3,933,672; 4,652,392; 4,978,471; 4,983,316; 5,288,431; 4,639,489; 4,749,740; and 4,798,679; 4,075,118; European Patent Application No. 89307851.9; EP 150,872; and DOS 2,124,526.

For any cleaning compositions to be used in automatic laundry washing machines, suds should not form to the extent that they overflow the washing machine. Suds suppressors, when utilized, are preferably present in a "suds suppressing amount." By "suds suppressing amount," it is meant that the formulator of the composition can select an amount of this suds controlling agent that will sufficiently control the suds to result in a low-sudsing laundry detergent for use in automatic laundry washing machines.

The compositions herein may comprise from 0% to about 10% of suds suppressor. When utilized as suds suppressors, monocarboxylic fatty acids, and salts therein, may present in amounts of up to about 5%, by weight, of the cleansing composition. In some examples, from about 0.5% to about 3%, by weight of the cleansing composition, of fatty monocarboxylate suds suppressor is utilized. Silicone suds suppressors may be utilized in amounts of up to about 2.0%, by weight of the cleansing composition, although higher amounts may be used. Monostearyl phosphate suds suppressors may be utilized in amounts ranging from about 0.1% to about 2%, by weight of the cleansing composition. Hydrocarbon suds suppressors may be utilized in amounts ranging from about 0.01% to about 5.0%, by weight of the cleansing composition, although higher levels can be used. The alcohol suds suppressors may be used at from about 0.2% to about 3% by weight of the cleansing composition.

Fabric Softeners

Various through-the-wash fabric softeners, including, for example, the impalpable smectite clays of U.S. Pat. No. 4,062,647, as well as other softener clays known in the art, can optionally be used at levels of from about 0.5% to about 10%, by weight of the cleaning composition, to provide fabric softener benefits concurrently with fabric cleaning. Clay softeners can be used in combination with amine and cationic softeners as disclosed, for example, in U.S. Pat. Nos. 4,375,416, and 4,291,071. Cationic softeners can also be used without clay softeners.

Conditioning Agents

The composition of the present invention may include a high melting point fatty compound. The high melting point fatty compound useful herein may have a melting point of 25° C. or higher, and is selected from the group consisting of fatty alcohols, fatty acids, fatty alcohol derivatives, fatty acid derivatives, and mixtures thereof. Such compounds of low melting point are not intended to be included in this section. Non-limiting examples of the high melting point compounds are found in International Cosmetic Ingredient Dictionary, Fifth Edition, 1993, and CTFA Cosmetic Ingredient Handbook, Second Edition, 1992.

The high melting point fatty compound may be included in the composition at a level of from about 0.1% to about 40%. In some examples, the high melting point fatty compound may be included in the composition at a level of from about 1% to about 30%. In other examples, the high melting point fatty compound may be included in the composition at a level of from about 1.5% to about 16% by weight of the composition. In further examples, the high melting point fatty compound may be included in the composition at a level of from about 1.5% to about 8%. The high melting point fatty compound may provide improved conditioning benefits such as slippery feel during the application to wet hair, and softness and moisturized feel on dry hair.

The cleaning compositions described herein may contain a cationic polymer. Concentrations of the cationic polymer in the composition may range from about 0.05% to about 3%. In some examples, concentrations of the cationic polymer in the composition may range from about 0.075% to about 2.0%. In other examples, concentrations of the cationic polymer in the composition may range from about 0.1% to about 1.0%. Suitable cationic polymers will have cationic charge densities of at least about 0.5 meq/gm, in some examples at least about 0.9 meq/gm, in other examples at least about 1.2 meq/gm, in further examples at least about 1.5 meq/gm, but may also be less than about 7 meq/gm, and in another example less than about 5 meq/gm, at the pH of intended use of the composition. Herein, "cationic charge density" of a polymer refers to the ratio of the number of positive charges on the polymer to the molecular weight of the polymer. The average molecular weight of such suitable cationic polymers will generally be between about 10,000 and 10 million, in some examples between about 50,000 and about 5 million, and in other examples between about 100,000 and about 3 million.

Suitable cationic polymers for use in the compositions described herein may contain cationic nitrogen-containing moieties such as quaternary ammonium or cationic protonated amino moieties. Any anionic counterions can be used in association with the cationic polymers so long as the polymers remain soluble in water, in the composition, or in a coacervate phase of the composition, and so long as the counterions are physically and chemically compatible with the essential components of the composition or do not otherwise unduly impair product performance, stability or aesthetics. Non-limiting examples of such counterions include halides (e.g., chloride, fluoride, bromide, iodide), sulfate and methylsulfate.

Non-limiting examples of such polymers are described in the CTFA Cosmetic Ingredient Dictionary, 3rd edition, edited by Estrin, Crosley, and Haynes, (The Cosmetic, Toiletry, and Fragrance Association, Inc., Washington, D.C. (1982)).

Other suitable cationic polymers for use in the composition include polysaccharide polymers, cationic guar gum derivatives, quaternary nitrogen-containing cellulose ethers, synthetic polymers, copolymers of etherified cellulose, guar and starch. When used, the cationic polymers herein may be either soluble in the composition or soluble in a complex coacervate phase in the composition formed by the cationic polymer and the anionic, amphoteric and/or zwitterionic surfactant component described hereinbefore. Complex coacervates of the cationic polymer can also be formed with other charged materials in the composition.

Suitable cationic polymers are described in U.S. Pat. Nos. 3,962,418; 3,958,581; and U.S. Publication No. 2007/0207109 A1, which are all hereby incorporated by reference.

The cleaning compositions described herein may include a nonionic polymer as a conditioning agent. Polyalkylene glycols having a molecular weight of more than about 1000 may be useful herein. Examples of useful nonionic polymers may include those having the following general formula:

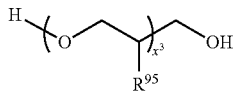

wherein $R^{95}$ is selected from the group consisting of H, methyl, and mixtures thereof.

Conditioning agents, and in particular silicones, may be included in the composition. The conditioning agents useful in the cleaning compositions described herein may comprise a water insoluble, water dispersible, non-volatile, liquid that forms emulsified, liquid particles. Suitable conditioning agents for use in the composition are those conditioning agents characterized generally as silicones (e.g., silicone oils, cationic silicones, silicone gums, high refractive silicones, and silicone resins), organic conditioning oils (e.g., hydrocarbon oils, polyolefins, and fatty esters) or combinations thereof, or those conditioning agents which otherwise form liquid, dispersed particles in the aqueous surfactant matrix herein. Such conditioning agents should be physically and chemically compatible with the essential components of the composition, and should not otherwise unduly impair product stability, aesthetics or performance.

The concentration of the conditioning agent in the composition should be sufficient to provide the desired conditioning benefits. Such concentration can vary with the conditioning agent, the conditioning performance desired, the average size of the conditioning agent particles, the type and concentration of other components, and other like factors.

The concentration of the silicone conditioning agent may range from about 0.01% to about 10%. Non-limiting examples of suitable silicone conditioning agents, and optional suspending agents for the silicone, are described in U.S. Reissue Pat. No. 34,584, U.S. Pat. Nos. 5,104,646; 5,106,609; 4,152,416; 2,826,551; 3,964,500; 4,364,837; 6,607,717; 6,482,969; 5,807,956; 5,981,681; 6,207,782; 7,465,439; 7,041,767; 7,217,777; US Patent Application Nos. 2007/0286837A1; 2005/0048549A1; 2007/0041929A1; British Pat. No. 849,433; German Patent No. DE 10036533, which are all incorporated herein by reference; Chemistry and Technology of Silicones, New York: Academic Press (1968); General Electric Silicone Rubber Product Data Sheets SE 30, SE 33, SE 54 and SE 76; Silicon Compounds, Petrarch Systems, Inc. (1984); and in Encyclopedia of Polymer Science and Engineering, vol. 15, 2d ed., pp 204-308, John Wiley & Sons, Inc. (1989).

The cleaning compositions described herein may also comprise from about 0.05% to about 3% of at least one organic conditioning oil as the conditioning agent, either alone or in combination with other conditioning agents, such as the silicones (described herein). Suitable conditioning oils may include hydrocarbon oils, polyolefins, and fatty esters. Also suitable for use in the compositions herein are the conditioning agents described by the Procter & Gamble Company in U.S. Pat. Nos. 5,674,478, and 5,750,122. Also suitable for use herein are those conditioning agents described in U.S. Pat. Nos. 4,529,586, 4,507,280, 4,663,158, 4,197,865, 4,217,914, 4,381,919, and 4,422,853, which are all.

Humectant

The cleaning compositions described herein may contain a humectant. The humectants herein may be selected from the group consisting of polyhydric alcohols, water soluble alkoxylated nonionic polymers, and mixtures thereof. The humectants, when used herein, may be used at levels of from about 0.1% to about 20%, and in some examples, from about 0.5% to about 5%.

Suspending Agent

The cleaning compositions described herein may comprise a suspending agent at concentrations effective for suspending water-insoluble material in dispersed form in the compositions or for modifying the viscosity of the composition. Such concentrations may range from about 0.1% to about 10%, and in some examples, from about 0.3% to about 5.0%.

Examples of suspending agents useful herein include anionic polymers and nonionic polymers (e.g., vinyl polymers, acyl derivatives, long chain amine oxides, and mixtures thereof, alkanol amides of fatty acids, long chain esters of long chain alkanol amides, glyceryl esters, primary amines having a fatty alkyl moiety having at least about 16 carbon atoms, secondary amines having two fatty alkyl moieties each having at least about 12 carbon atoms). Examples of suspending agents are also described in U.S. Pat. No. 4,741,855.

Suds Boosters

If high sudsing is desired, suds boosters such as the $C_{10}$-$C_{16}$ alkanolamides can be incorporated into the compositions, at, for e.g., levels from about 1% to about 10%. The $C_{10}$-$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, water-soluble magnesium and/or calcium salts such as $MgCl_2$, $MgSO_4$, $CaCl_2$, $CaSO_4$ and the like, can be added at levels of, for e.g., from about 0.1% to about 2%, to provide additional suds and to enhance grease removal performance.

Fillers and Carriers

Another component of the cleaning compositions described herein is a filler and/or carrier of the composition. As used herein, either in the specification or in a claim, the terms "filler" and "carrier" have the same meaning and can be used interchangeably.

The liquid detergent compositions may contain water and/or other solvents as fillers or carriers. Low molecular weight primary or secondary alcohols exemplified by methanol, ethanol, propanol, and isopropanol are suitable. Monohydric alcohols may be used in some examples for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used.

The compositions may contain from about 5% to about 90%, and in some examples, about 10% to about 50%, by weight of the composition, of such carriers. Isoprenoid-derived surfactants are particularly suited for compact or super-compact liquid or liquid-containing detergent compositions. For compact or super-compact heavy duty liquid or other detergent forms, the use of water may be lower than about 40%, or lower than about 20%, or lower than about 5%, or less than about 4% or less than about 3% free water, or less than about 2%, by weight of the composition, of free water, or substantially free of free water (i.e. anhydrous).

For either compacted or supercompacted liquid detergents, the level of liquid filler in the product may be reduced, such that either the same amount of active chemistry is delivered to the wash liquor as compared to noncompacted detergents, or in some examples, the cleaning system (surfactants and other adjuncts named herein above) is more efficient such that less active chemistry is delivered to the wash liquor as compared to noncompacted detergents, such as, for e.g., via the use of the novel enzyme-containing liquid cleaning compositions described herein. For example, the wash liquor may be formed by contacting the laundry cleaning composition with water in such an amount so that the concentration of laundry cleaning composition in the wash liquor is from above 0 g/l to about 4 g/l. In some examples, the concentration may be from about 0.5 g/l or about 1 g/l to about 3.5 g/l, or to about 3.0 g/l, or to about 2.5 g/l, or to about 2.0 g/l, or to about 1.5 g/l, or even to about 1.0 g/l. These dosages are not intended to be limiting, and other dosages may be used that will be apparent to those of ordinary skill in the art.

Methods of Use

Described herein is a method for cleansing hair or skin. Such method includes the steps of contacting said hair or skin with a wash solution comprising water and the cleaning composition of as described herein. The skin or hair may optionally be rinsed after contact with the wash solution. The compositions may be employed at concentrations of from about 200 ppm to about 10,000 ppm in solution. The water temperatures may range from about 5° C. to about 40° C.

Also described herein is a method for cleaning fabrics. Such method includes the steps of providing one or more fabrics to which stains are adhered, and contacting said fabrics with a wash solution. The wash solution comprises water; and a cleaning composition as described herein. The cleaning fabrics may optionally be rinsed after contact with the wash solution. The compositions may be employed at concentrations of from about 200 ppm to about 10,000 ppm in solution. The water temperatures may range from about 5° C. to about 100° C. The water to fabric ratio may be from about 1:1 to about 20:1.

EXAMPLES

In the following Examples, unless otherwise indicated, the ingredients within the liquid cleaning compositions are expressed as weight percentages, based on the total weight of the total compositions.

Example 1

Liquid Laundry Cleaning Compositions

The following liquid laundry cleaning compositions are prepared by traditional means known to those of ordinary skill in the art by mixing the following ingredients. Composition A uses citric acid (comparative example), while Composition B (directed to the inventive cleaning compositions described herein) uses lactic acid.

| | Composition A (citric acid - comp.) WT % | Composition B (lactic acid) WT % |
|---|---|---|
| Ingredients | | |
| $AE_{1.8}S$ | 17.00 | 17.79 |
| $C_{11.8}$ linear alkyl benzene sulfonic acid | 2.80 | 2.96 |
| HSAS[1] | 14.70 | 15.42 |
| $C_{24}$ alcohol, EO9[2] | 2.30 | 2.37 |
| Citric Acid Solution | 5.07 | 1.98[3] |
| Lactic Acid Solution | — | 6.51 |
| $C_{12}$-$C_{18}$ Fatty Acid | 2.36 | 2.47 |
| Protease (54.5 mg/g)[4] | 7.62 | 7.98 |
| NATALASE ® (29.26 mg/g)[5] | 2.54 | 2.67 |
| Borax | 4.72 | 4.94 |
| Calcium Formate | 0.15 | 0.16 |
| PEI 600, EO20 | 1.65 | 1.73 |
| PEI 600, EO24, PO16 | 1.65 | 1.73 |
| DTPA[6] (50% active) | 0.28 | 0.30 |
| Tiron ® | 0.84 | 0.89 |
| Optical Brightener | 0.34 | 0.37 |
| Ethanol | 0.97 | 4.10 |
| Propylene Glycol | 4.90 | 5.16 |
| Monoethanolamine (MEA) | 1.12 | 1.17 |
| Caustic Soda (NaOH) | 3.50 | 3.74 |
| Na Formate | 0.61 | 0.64 |
| Suds Suppressor | — | 0.10 |
| Dye | 0.0025 | 0.0025 |
| Perfume | 0.85 | 0.85 |
| PROPERTIES | | |
| Neat pH | pH 4.2 | pH 5 |

[1]HSAS is a mid-chain branched alcohol ethoxylated sulfate.
[2]Non-ionic ethoxylated alkyl alcohol available from Huntsman Corp., Austin, Tex.
[3]Citric acid is introduced as a raw material impurity.
[4]Available from Genencor International, South San Francisco, CA.
[5]Available from Novozymes, Bagsvaerd, Denmark.
[6]DTPA is diethylenetriaminepentaacetic acid.

Example 2

Stain Removal

Stain removal characteristics of the cleaning composition containing citric acid (A) are compared to the cleaning composition containing lactic acid (B). The compositions of Example 1 containing citric acid (Composition A) and lactic acid (Composition B) as indicated above are prepared for use in automatic washing machines. A 25 g dose of each liquid cleaning composition is poured into the dispenser of a North American front loading washer or placed into the heart of the washer (in a cup or cap). Artificially soiled fabrics representing a range of typical consumer stains, as listed below, are placed in each washing machine. Washing takes place in 18.9 L of water at 100° F. for 12 minutes followed by a 2- to 5-minute rinse at 70° F. with water of hardness 6 gpg. The stains tested are supplied by EMC Empirical Manufacturing Company. Fabrics are dried with an automatic dryer until dry before SRI measurements are taken.

The Stain Removal Index (SRI) is measured using a modified version of the "Standard Guide for Evaluating Stain Removal Performance in Home Laundering" (ASTM D4265-98). The modifications include the following: at least 3 external replicates and at least 3 internal replicates are tested; the stain is applied by placing the fabric on a flat surface and applying the stain using a pipette for liquids or a brush for solids with a predetermined amount each time; modified artificial sebum and air filter dirt are not tested.

A value of 0 on the SRI scale is equivalent to zero removal of the initial stain, while a value of 100 indicates complete removal. Values less than 0 indicate a darkening of the stain while values greater than 100 indicate fabric whiter than the unstained reference. Scores for each stain were calculated and are listed in Data Table 1 below. The results in Data Table 1 show that a cleaning composition containing lactic acid (B) provides an improved stain removal benefit as compared to a cleaning composition containing citric acid (A).

DATA TABLE 1

| Stain Removal | | |
|---|---|---|
| | Stain Removal Index (SRI) | |
| Stain | Composition A (citric acid - comp.) | Composition B (lactic acid) |
| Blood | 84.8 | 88.8 |
| Chocolate | 77.2 | 89.9 |
| Gravy | 72.2 | 89.5 |
| Grass | 62.1 | 79.8 |

Example 3

Composition Stability

Composition Preparation:

Partially completed formulations of compositions with citric acid (C) and with a citric/lactic acid combination (D) are made by leaving out the perfume, dyes, enzymes, caustic (NaOH) and water. Each formula is weighed into aliquots of 50 g minus the mass of the missing components. The pH is adjusted with H2SO4 or NaOH to a target pH; the target pH of a given formulation may be, for example, about 3, about 3.33, about 3.67, about 4, about 4.33, about 4.67, about 5, about 5.17, about 5.33, about 5.67, or about 6. The total weight is then brought to 50 g minus the enzyme mass with deionized water. At this point, the enzymes may be added immediately, or the composition may be stored overnight. The protease is added first, and the composition is stirred with an overhead mixer for a minimum of 15 minutes to insure stabilization by the borate before the addition of the amylase. The amylase is added next, and the composition is stirred for an additional 5 minutes. The initial enzyme levels are measured at approximately two hours after their addition.

The day that the enzymes are added is designated as Day 1, and measures of protease and amylase activity as described below are taken at 2 week intervals and at desired pH(s). The enzyme activity level is reported as a percentage relative to the initial activity level.

Prepare a diluent solution of 0.5 g calcium chloride dihydrate (Sigma-Aldrich, cat. #C-5080) and 10 g sodium thiosulfate pentahydrate (Sigma-Aldrich, cat. #S-6672) in 1 liter of deionized water (18.2 mega Ohms MΩ or better). Prepare a TRIS buffer of 12.1 g tris-hydroxymethyl-aminomethane (Sigma-Aldrich, cat. #-1503), 1.1 g of calcium chloride dihydrate and 5.0 g sodium thiosulfate pentahydrate, pH 8.3 in 1 liter of deionized water. Prepare a working PNA solution by diluting 250 uL of a 1 gram of N-Succinyl-ALA-ALA-PRO-PHE p-nitroanilide ("PNA"; Sigma-Aldrich, cat. #S-7388) per 10 mL dimethyl sulfoxide (J.T. Baker, cat. #JT9224-1) into 25 mL TRIS buffer.

Protease analysis. Protease analysis is carried out by reaction of a protease containing sample with Succinyl-Ala-Ala-Pro-Phe p-nitroanilide resulting in a change in absorbance over time spectrophotometrically. The response is proportional to the level of protease present in the sample. The protease sample is prepared by dilution in diluent solution. The reaction begins by incubation of 250 uL of working PNA solution at 37° C. for 360 seconds then delivery of 25 uL sample preparation and monitoring change in absorbance at 405 nm. The protease active level is determined by relation to a protease level vs. reaction rate calibration established for that specific protease. For example, a reference curve may be established by measuring post-reaction absorbance as described above over a range of known enzyme concentrations, for example, from about 1 mg enzyme/100 g product to about 100 mg enzyme/100 g product.

Amylase analysis. The amylase reaction uses a combination of the alpha amylase present in the sample and an alpha glucosidase to react with a modified p-nitrophenylmaltoheptaside containing a terminal glucose unit blocked with an ethylidene group. This terminal blocking inhibits cleavage by the alpha-glucosidase until the initial internal bonds can be cleaved by the alpha-amylase followed by alpha-glucosidase. The increase in absorbance (@ 405 nm) per minute, facilitated by the release of pNP by the alpha-glucosidase, is directly proportional to the alpha-amylase activity in the sample. The amylase sample is prepared by dilution in diluent solution. The reaction reagents are provided in Infinity amylase reagent (Thermo Electron, cat. #T-1503). The reaction begins by incubation of 190 uL of Infinity amylase reagent at 37° C. for 360 seconds then delivery of 50 uL of the diluted sample preparation and monitoring the change in absorbance at 405 nm spectrophotometrically. The amylase active level is determined by relation to an amylase level vs. reaction rate calibration established for that specific amylase. For example, a reference curve may be established by measuring post-reaction absorbance as described above over a range of known enzyme concentrations, for example, from about 1 mg enzyme/100 g product to about 100 mg enzyme/100 g product.

| | Composition C (citric acid - comp.) WT % Active | Composition D (lactic acid) WT % Active |
|---|---|---|
| Ingredients | | |
| $AE_{1.8}S$ | 16.3 | 16.3 |
| $C_{11.8}$ linear alkyl benzene sulfonic acid | 2.8 | 2.8 |
| HSAS[1] | 13.6 | 13.6 |
| C24 alcohol, EO9[2] | 2.2 | 2.2 |
| Citric Acid | 6.8 | 0.9 |
| Lactic Acid | 0.0 | 5.8 |
| $C_{12}$-$C_{18}$ Fatty Acid | 2.3 | 2.3 |
| Protease (55.3 mg/g) [3] | 1.7 | 1.7 |
| Amylase (25.4 mg/g) [4] | 0.7 | 0.7 |
| Borax | 3.6 | 3.6 |
| Calcium Formate | 0.2 | 0.2 |
| Polyethyleneimine 600, EO20 | 1.6 | 1.6 |
| Polyethyleneimine 600, EO24, PO16 | 1.6 | 1.6 |
| DTPA[5] | 0.3 | 0.3 |
| Tiron ® [6] | 0.8 | 0.8 |
| Optical Brightener [7] | 0.3 | 0.3 |
| Ethanol | 4.4 | 4.4 |
| Propylene Glycol | 5.2 | 5.2 |
| Monoethanolamine | 1.1 | 1.1 |
| NaOH | 4.0 | 4.0 |
| Na Cumene Sulfonate | 1.1 | 1.1 |
| Na Formate | 0.2 | 0.2 |
| Dye | 0.1 | 0.1 |
| Perfume | 0.9 | 0.9 |
| PROPERTIES | | |
| Neat pH | pH 5.0 | pH 5.0 |

[1]HSAS is a mid-chain branched alcohol ethoxylated sulfate.

[2]Non-ionic ethoxylated alkyl alcohol available from Huntsman Corp., Austin, Tex.

[3] As described in US patent application 2011/0237487A1, incorporated herein by reference

[4] Termamyl Ultra 300L ® From Genencor

[5]DTPA is diethylenetriaminepentaacetic acid

[6] 4,5-Dihydroxy-1,3-benzenedisulfonic acid disodium salt, Sigma Aldrich

[7] Disodium 4,4'-bis{[4-anilino-6- morpholino-s-triazin-2-yl]-amino}-2,2'-stilbenedisulfonate (Brightener 15; CAS# 16090-02-1), available from Ciba

DATA TABLE 2

Citric vs Lactic acid formulas: 2 week stability across pH range

| Protease | | | | Amylase | | | |
|---|---|---|---|---|---|---|---|
| Composition C (citric) | | Composition D (lactic) | | Composition C (citric) | | Composition D (lactic) | |
| pH | 2 wk % of initial | pH | 2 wk % of initial | pH | 2 wk % of initial | pH | 2 wk % of initial |
| 2.95 | 0% | 3.07 | 0% | 2.95 | 0% | 3.07 | 0% |
| 3.32 | 0% | 3.37 | 0% | 3.32 | 0% | 3.37 | 0% |
| 3.7 | 0% | 3.7 | 0% | 3.7 | 0% | 3.7 | 0% |
| 4.09 | 0% | 3.94 | 0% | 4.09 | 1% | 3.94 | 45% |
| 4.37 | 1% | 4.28 | 50% | 4.37 | 67% | 4.28 | 88% |
| 4.62 | 0% | 4.64 | 71% | 4.62 | 91% | 4.64 | 88% |
| 4.97 | 72% | 5.03 | 83% | 4.97 | 90% | 5.03 | 90% |
| 5.37 | 95% | 5.26 | 89% | 5.37 | 97% | 5.26 | 92% |
| 5.63 | 97% | 5.77 | 92% | 5.63 | 101% | 5.77 | 95% |
| 6.05 | 95% | 6.11 | 86% | 6.05 | 99% | 6.11 | 92% |

Data Table 2 shows that lactic acid provides greater enzyme stability benefits at lower pHs after two weeks when compared to citric acid.

DATA TABLE 3

Citric vs Lactic acid formulas: long term stability at about pH 5.17

| | Enzyme | | | |
|---|---|---|---|---|
| | Protease | | Amylase | |
| | Composition C (citric) | Composition D (lactic) | Composition C (citric) | Composition D (lactic) |
| pH | 5.165 | 5.17 | 5.165 | 5.17 |
| 2 Weeks % Initial | 92.85% | 94.30% | 95.84% | 92.05% |
| 6 Weeks % Initial | 88.65% | 97.93% | 85.04% | 87.78% |
| 12 Weeks % Initial | 71.02% | 96.41% | 56.55% | 75.10% |
| 24 Weeks % Initial | 48.35% | 97.19% | 25.13% | 53.31% |

Data Table 3 shows that lactic acid provides enzyme stability benefits at about pH 5.17 over 24 weeks when compared to citric acid.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

We claim:

1. A liquid cleaning composition having improved protease stability upon storage, the composition comprising:

a) from about 10% to about 45%, by weight of the liquid cleaning composition, of a surfactant system comprising from about 35% to about 90%, by weight of the surfactant system, of one or more anionic surfactants, wherein the surfactant system further comprises from about 2% to about 10%, by weight of the surfactant system, of one or more non-ionic surfactants, wherein the one or more anionic surfactant comprises a mixture of linear alkyl benzene sulfonates and alkyl ethoxylated sulfates, and wherein the one or more non-ionic surfactant comprises an ethoxylated nonionic surfactant, wherein the weight ratio of anionic surfactant to non-ionic surfactant is at least about 5:1;

b) from about 0.01% to about 1%, by weight of the liquid cleaning composition, of protease; less than about 30% water; and c) from about 5% to about 10%, by weight of the liquid cleaning composition, of lactic acid;

wherein the cleaning composition has a neat pH of from about 4.28 to about 5.17.

2. The cleaning compositions of claim 1, wherein the organic acidulant donates only one proton per molecule.

3. The cleaning composition of claim 1, wherein no citric acid is intentionally added, other than as an impurity in a raw material component of the composition.

4. The cleaning composition of claim 1, wherein the composition comprises between about 10% and about 28% water.

5. The cleaning composition of claim 1, wherein the composition comprises from about 30% to about 45%, by weight of the liquid cleaning composition, of the surfactant system.

6. The cleaning composition of claim 1, wherein the composition further comprises other enzymes that are not protease.

7. The cleaning composition of claim 6, wherein the other enzymes that are not protease are selected from the group consisting of cellulases, hemicellulases, peroxidases, glucoamylases, amylases, xylanases, lipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and mixtures thereof.

8. The cleaning composition of claim 6, wherein the other enzymes that are not protease comprise amylase.

9. A liquid cleaning composition having improved enzyme stability upon storage, the composition comprising:

a) from about 10% to about 45%, by weight of the liquid cleaning composition, of a surfactant system comprising from about 35% to about 90%, by weight of the surfactant system, of one or more anionic surfactants, wherein the surfactant system further comprises from about 2% to about 10%, by weight of the surfactant system, of one or more non-ionic surfactants, wherein the one or more anionic surfactant comprises a mixture of linear alkyl benzene sulfonates and alkyl ethoxylated sulfates, and wherein the one or more non-ionic surfactant comprises an ethoxylated nonionic surfactant, wherein the weight ratio of anionic surfactant to non-ionic surfactant is at least about 5:1;

b) from about 0.01% to about 1%, by weight of the liquid cleaning composition, of a cleaning enzyme, wherein the cleaning enzyme comprises amylase; less than about 30% water; and c) from about 5% to about 10%, by weight of the liquid cleaning composition, of lactic acid;

wherein the cleaning composition has a neat pH of from about 4 to about 5.17.

10. The cleaning composition of claim 9, wherein the composition comprises between about 10% and about 28% water.

11. The cleaning composition of claim 9, wherein the composition further comprises a cleaning polymer comprising an alkoxylated polyamine selected from ethoxylated polyethyleneimine, ethoxylated hexamethylene diamine, sulfated versions thereof, polypropoxylated derivatives thereof, and mixtures thereof.

* * * * *